US011008712B1

(12) United States Patent
Scigliano et al.

(10) Patent No.: US 11,008,712 B1
(45) Date of Patent: May 18, 2021

(54) EPOXY TRUCK

(71) Applicant: Nathan Contracting, Allison Park, PA (US)

(72) Inventors: Nathan Scigliano, Allison Park, PA (US); Scott Wayne Campbell, Acme, PA (US)

(73) Assignee: Nathan Contracting

( * ) Notice: Subject to any disclaimer, the term of this patent is extended or adjusted under 35 U.S.C. 154(b) by 240 days.

(21) Appl. No.: 16/279,231

(22) Filed: Feb. 19, 2019

Related U.S. Application Data

(60) Provisional application No. 62/632,223, filed on Feb. 19, 2018.

(51) Int. Cl.

| | |
|---|---|
| ***E01C 7/35*** | (2006.01) |
| ***E01C 19/21*** | (2006.01) |
| ***E01C 11/24*** | (2006.01) |
| ***E01C 19/16*** | (2006.01) |

(52) U.S. Cl.
CPC ..... *E01C 7/356* (2013.01); *E01C 11/24* (2013.01); *E01C 19/16* (2013.01); *E01C 19/21* (2013.01)

(58) Field of Classification Search
CPC ..... E01C 7/356; E01C 11/24; E01C 19/16; E01C 19/21
USPC ..... 404/83–116, 72, 75
See application file for complete search history.

(56) References Cited

U.S. PATENT DOCUMENTS

| | | | | |
|---|---|---|---|---|
| 9,109,332 | B1 | 8/2015 | Stone, Jr. | |
| 9,115,473 | B1 | 8/2015 | Stone, Jr. | |
| 9,567,716 | B2 | 2/2017 | Rainwater et al. | |
| 9,932,715 | B2 | 4/2018 | Rainwater et al. | |
| 2016/0115654 | A1* | 4/2016 | Pedersen | E01C 23/07 404/75 |
| 2016/0138228 | A1* | 5/2016 | Rainwater | E01C 19/176 404/111 |

OTHER PUBLICATIONS

"Automated High Friction Surfacing Treatments", dbiservices.com, 2016, https://www.dbiservices.com/automated-high-friction-surfacing-treatments.
"High Friction Surface Treatment", ventureconstruction.com, 2015, http://venture-construction.com/services/hfst/.
"Proven Performance Systems", poly-carb.com, 2017, www.poly-carb.com.

* cited by examiner

*Primary Examiner* — Raymond W Addie
(74) *Attorney, Agent, or Firm* — The Webb Law Firm

(57) ABSTRACT

A truck-mounted system for dispensing a coating to a road surface includes a coating storage and dispensing system and an aggregate storage and spreader system disposed on the truck chassis. The coating storage and dispensing system includes a liquid storage unit, a plurality of heating units, and a plurality of pumping units for separately storing, heating, and pumping the liquid components of the coating. The liquid components are mixed and dispensed to the road surface by a dispenser. The aggregate storage and spreader system includes a container for aggregate material and a spreader unit for dispensing the aggregate material to the road surface over the coating. The spreader unit is movable between folded and extended positions on the truck chassis.

20 Claims, 11 Drawing Sheets

EPOXY TRUCK

CROSS REFERENCE TO RELATED APPLICATION

The present application claims priority to U.S. Provisional Patent Application No. 62/632,223, filed on Feb. 19, 2018, which is incorporated herein by reference in its entirety.

BACKGROUND OF THE INVENTION

Field of the Invention

The invention relates to a truck-mounted system for dispensing a coating material to a road surface, and, in particular, a system that includes a coating storage and dispensing system and an aggregate storage and spreader system on a truck.

Description of Related Art

Local municipalities and regional departments of transportation, and highway boards, as well as the United States Federal Highway Administration, are increasingly utilizing High Friction Surface Treatments (HFST) on road surfaces in order to increase pavement friction, particularly at curved areas in a roadway and intersections, in order to reduce skidding and sliding at such locations, and thereby limit or prevent vehicle accidents at these locations and minimize resulting damage should an accident occur. HFST coatings applied to road surfaces typically include an epoxy or polyurethane liquid applied to an existing road surface (concrete or asphalt) to which an aggregate material, such as stone aggregate or bauxite, is applied prior to curing of the liquid. The epoxy or polyurethane coating typically includes two components, a resin and a hardener.

Various systems have been implemented to apply HFST coating to a road surface. Typical systems utilize a tank and dispensing system for storing the liquid coating and then dispensing the coating to a road surface. These systems only provide for storage and dispensing of the mixed resin and hardener. The mixed coating cannot be stored for a long period of time and any amount of mixture created for a project that is not utilized in a certain period of time must be discarded. The aggregate storage and dispensing and the liquid coating and storage dispensing functions are performed by separate equipment.

SUMMARY OF THE INVENTION

According to an example of the present disclosure, a truck-mounted system for applying an HFST coating to a road surface is provided. The system is configured to provide automated broadcast of aggregate material at a variable spreading area, which requires less manpower. The system also provides for heating of the liquid components, resin and hardener, of the epoxy coating to allow for a wide variety of working conditions and constant ratio mixing. Flow rates and mixing ratios are monitored in real time, generating increased quality control with less human interaction. On-board aggregate storage allows for operation without additional machinery.

According to this example, the truck-based system is semi-automated in that the system mixes the liquid components of the epoxy coating into appropriate ratios and then transfers the mixed epoxy coating to the road surface being treated. In addition, the system also semi-automatically spreads an aggregate material, such as stone, into the coating as it is applied. The setup, maintenance, and operation of the system is still largely dependent upon manual operation and labor.

Additionally, the machines are equipped to semi-autonomously manage the heating and storage of the liquid components of the epoxy coating. The transfer of the liquid components from separate tanks via pumps to a mixing device is highly dependent upon the viscosity of the components. The viscosity of the components is highly dependent upon temperature. As a result, management of the temperature of the liquid components of the epoxy and viscosity is an important component of machine operation.

Another important component of epoxy conveyance is the monitoring of the mixing process to assure that the liquid components are mixed at the proper ratio. The system can perform automatic stoppage of material conveyance if an out-of-ratio mix is detected.

The aggregate transference can be defined as the movement of aggregate from the aggregate hopper to a spreading device. The transference from the hopper is initiated via an auger in the bottom of the hopper. After exiting the hopper, the aggregate drops onto a conveyor belt. The conveyor belt carries the aggregate to a standard centrifugal spreader. The conveyor consists of a two-part articulated design that allows for the folding of the conveyor into a compact form factor for travel while preserving adequate dimensions for operation. The spreader has a hopper, wherein the stone is collected after exiting the conveyor belt. The centrifugal spreader then spreads the stone onto the uncured coating applied to the road surface.

Aggregate transference and epoxy spreading occur concurrently. The truck that carries these systems is driven forward at an appropriate rate to allow continuous conveyance and application of epoxy coating and aggregate.

According to another example of the present disclosure, a truck-mounted system for dispensing a coating to a road surface is provided. The system includes a truck chassis; a coating storage and dispensing system disposed on the truck chassis; and an aggregate storage and spreader system disposed on the truck chassis. The coating storage and dispensing system includes a liquid storage unit configured to separately contain individual liquid components of the coating; a heating system including a plurality of heater units, each heater unit being configured to heat a respective one of the individual liquid components to a predetermined or desired viscosity; a pumping system including a plurality of pumping units, each pumping unit configured to pump a respective one of the individual liquid components from the liquid storage unit; a control unit configured to operate the pumping units to pump the individual liquid components from the liquid storage unit at a predetermined or desired ratio for forming the coating; and a dispenser for dispensing the coating to the road surface, the individual liquid components of the coating being mixed at the dispenser. The aggregate storage and spreader system includes a hopper unit configured to contain an aggregate material; an auger disposed at a bottom of the hopper unit, the auger being configured to dispense the aggregate material from a bottom of the hopper unit; a conveyor assembly configured to direct the aggregate material from the bottom of the hopper unit to a rear of the truck chassis, the conveyor assembly being movable between a folded position in which the conveyor assembly is retained on the truck chassis and an extended position in which the conveyor assembly extends rearwardly from the truck chassis, the conveyor assembly including at least one conveyor belt; and a spreader unit connected to the conveyor assembly, the spreader unit being configured to dispense the aggregate material from the conveyor assembly to the road surface. The spreader unit is movable with the conveyor assembly between the folded and extended positions.

Further examples of the present disclosure will now be described in the following numbered clauses.

Clause 1: A truck-mounted system for dispensing a coating to a road surface, comprising: a truck chassis; a coating storage and dispensing system disposed on the truck chassis, the coating storage and dispensing system comprising: a liquid storage unit configured to separately contain a plurality of individual liquid components of the coating; a heating system comprising a plurality of heater units, each heater unit being configured to heat a respective one of the plurality of individual liquid components to achieve a predetermined viscosity; a pumping system comprising a plurality of pumping units, each pumping unit configured to pump a respective one of the plurality of individual liquid components from the liquid storage unit; a control unit configured to operate the pumping units to pump the plurality of individual liquid components from the liquid storage unit at a predetermined ratio for forming the coating; and a dispenser configured to mix the plurality of individual liquid components pumped from the liquid storage units and dispense the coating to the road surface; and an aggregate storage and spreader system disposed on the truck chassis, the aggregate storage and spreader system comprising: a hopper unit comprising a storage volume configured to contain an aggregate material; an auger disposed at a bottom of the hopper unit, the auger being configured to dispense the aggregate material from the bottom of the hopper unit; a conveyor assembly configured to direct the aggregate material from the bottom of the hopper unit to a rear of the truck chassis, the conveyor assembly being movable between a folded position in which the conveyor assembly is retained on the truck chassis and an extended position in which the conveyor assembly extends rearwardly from the truck chassis, the conveyor assembly comprising at least one conveyor belt; and a spreader unit connected to the conveyor assembly, the spreader unit being configured to dispense the aggregate material from the conveyor assembly to the road surface, wherein the spreader unit is movable with the conveyor assembly between the folded and extended positions.

Clause 2: The truck-mounted system according to clause 1, wherein the plurality of individual liquid components comprises an epoxy resin liquid component and a hardener liquid component.

Clause 3: The truck-mounted system according to clause 1 or clause 2, wherein the dispenser comprises a hand grip having an actuation switch disposed thereon for activating the dispenser, an injection chamber through which the individual liquid components are received into the dispenser, a threaded nozzle bung, and a static mix nozzle connected to the threaded nozzle bung, the individual liquid components being mixed in the static mix nozzle.

Clause 4: The truck-mounted system according to any one of clauses 1-3, wherein the conveyor assembly comprises a first portion that, when in the extended position, is sloped upwardly from the bottom of the hopper unit and a second portion that, when in the extended position, extends rearwardly from the truck chassis, the first portion and the second portion of the conveyor assembly being pivotably connected, and the at least one conveyor belt extending across the first portion and the second portion.

Clause 5: The truck-mounted system according to any one of clauses 1-4, wherein the spreader unit comprises a cone-shaped hopper configured to receive the aggregate material from the at least one conveyor belt and a rotating plate disposed beneath the cone-shaped hopper that is configured to spin to create an outward spread of the aggregate material from the spreader unit to the road surface.

Clause 6: The truck-mounted system according to any one of clauses 1-5, further comprising a generator configured to supply power to the coating storage and dispensing system and the aggregate storage and spreader system.

Clause 7: A system for dispensing a coating to a road surface, comprising: a coating storage and dispensing system, comprising: a liquid storage unit configured to separately contain a plurality of individual liquid components of the coating; a heating system comprising a plurality of heater units, each heater unit being configured to heat a respective one of the plurality of individual liquid components to achieve a predetermined viscosity; a pumping system comprising a plurality of pumping units, each pumping unit configured to pump a respective one of the plurality of individual liquid components from the liquid storage unit; a control unit configured to operate the pumping units to pump the plurality of individual liquid components from the liquid storage unit at a predetermined or desired ratio for forming the coating; and a dispenser for dispensing the coating to the road surface, the plurality of individual liquid components of the coating being mixed at the dispenser; and an aggregate storage and spreader system comprising: a container comprising a storage volume configured to contain an aggregate material; and a spreader unit in communication with the container and configured to dispense the aggregate material from the container to the road surface.

Clause 8: The system according to clause 7, wherein the coating storage and dispensing system and the aggregate storage and spreader system are configured to be mounted on a truck chassis.

Clause 9: The system according to clause 7 or clause 8, wherein the container of the aggregate storage and spreader system comprises a hopper unit and an auger disposed at a bottom of the hopper unit, the auger being configured to dispense the aggregate material from the bottom of the hopper unit.

Clause 10: The system according any one of clauses 7-9, wherein the aggregate storage and spreader system further comprises a conveyor assembly configured to direct the aggregate material from the container to the spreader unit, the conveyor assembly comprising at least one conveyor belt and being movable between a folded position and an extended position, the spreader unit being movable with the conveyor assembly between the folded and extended positions.

Clause 11: The system according to clause 10, wherein the conveyor assembly comprises at least two pivotably connected portions and the at least one conveyor belt extends across the at least two pivotably connected portions.

Clause 12: The system according to any one of clauses 7-11, wherein the plurality of individual liquid components comprises an epoxy resin liquid component and a hardener liquid component.

Clause 13: The system according to any one of clauses 7-12, wherein the dispenser comprises a hand grip having an actuation switch disposed thereon for activating the dispenser, an injection chamber through which the individual liquid components are received into the dispenser, a threaded nozzle bung, and a static mix nozzle connected to the threaded nozzle bung, the individual liquid components being mixed in the static mix nozzle.

Clause 14: The system according to any one of clauses 7-13, wherein the spreader unit comprises a cone-shaped hopper configured to receive the aggregate material from the container and a rotating plate disposed beneath the cone-shaped hopper that is configured to spin to create an outward spread of the aggregate material from the spreader unit to the road surface.

Clause 15: The system according to any one of clauses 7-14, further comprising a generator configured to supply power to the coating storage and dispensing system and the aggregate storage and spreader system.

Clause 16: A method for dispensing a coating to a road surface, comprising: providing a truck chassis; separately containing a plurality of individual liquid components of the coating in a liquid storage unit disposed on the truck chassis; storing aggregate material in a hopper unit disposed on the truck chassis; separately heating each of the plurality of individual liquid components to achieve a predetermined viscosity; moving the truck chassis along the road surface; separately pumping each of the plurality of individual liquid components from the liquid storage unit to a dispenser at a predetermined ratio for forming the coating; mixing each of the plurality of individual liquid components at the dispenser; dispensing a mixed liquid coating to the road surface; conveying the aggregate material from the hopper unit to a spreader unit extended from a rear of the truck chassis; and dispensing the aggregate material to the road surface with the spreader unit after the coating has been dispensed to the road surface.

Clause 17: The method according to clause 16, wherein the conveying step is performed by a conveyor assembly movably disposed on the truck chassis and the spreader unit is connected to the conveyor assembly, the method further comprising moving the conveyor assembly and the spreader unit between a folded position in which the conveyor assembly and spreader unit are retained on the truck chassis and an extended position in which the conveyor assembly and spreader unit extend rearwardly from the truck chassis.

Clause 18: The method according to clause 16 or clause 17, wherein the plurality of individual liquid components comprises an epoxy resin liquid component and a hardener liquid component.

Clause 19: The method according to any one of clauses 16-18, wherein the heating step comprises circulating each of the plurality of individual liquid components between a respective heater unit and the liquid storage unit.

Clause 20: The method according to any one of clauses 16-19, wherein the step of dispensing the coating to the road surface comprises pouring the mixed liquid coating from the dispenser onto the road surface and spreading the mixed liquid coating evenly over the road surface.

These and other features and characteristics of the present invention, as well as the methods of operation and functions of the related elements of structures and the combination of parts and economies of manufacture, will become more apparent upon consideration of the following description and with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE INVENTION

Figure 1:
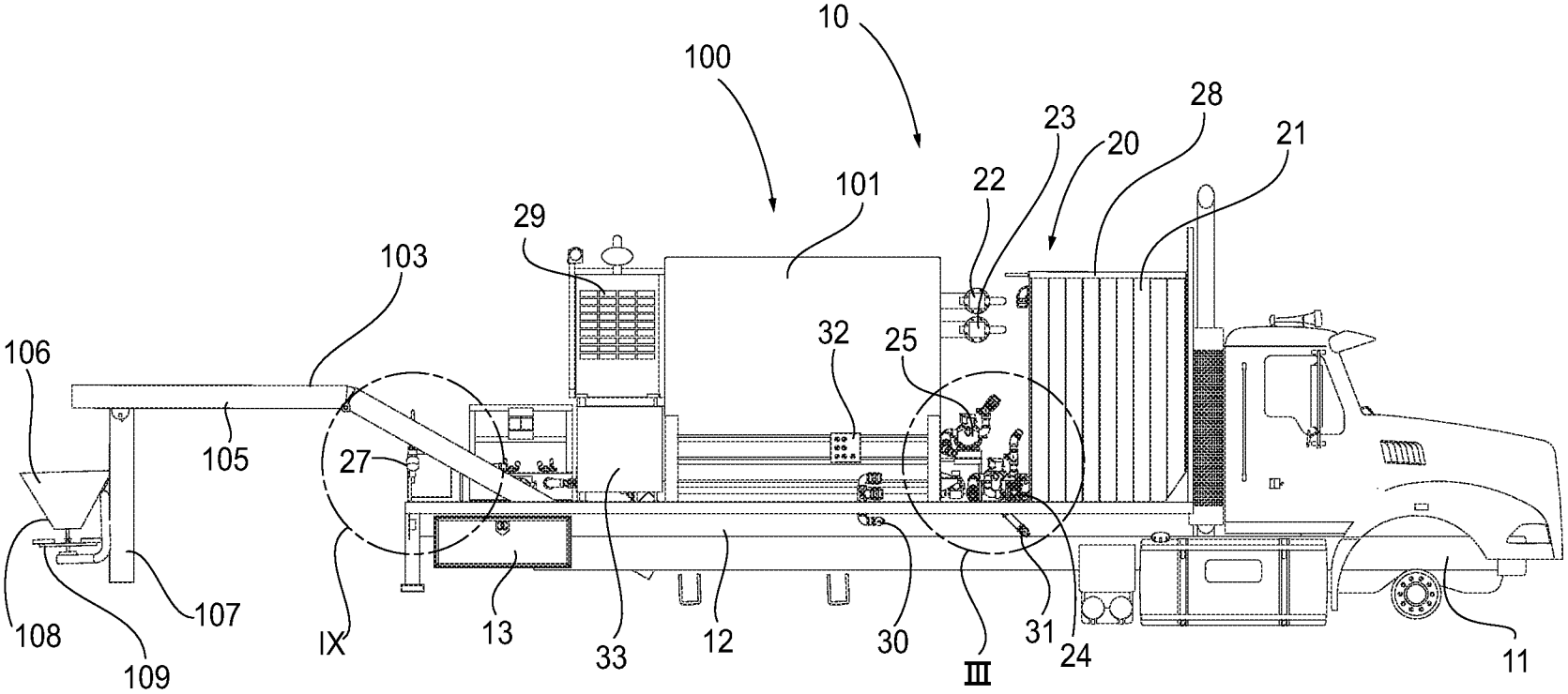
FIG. 1 is a side view of a truck-mounted system for dispensing a coating to a road surface in accordance with an example of the present disclosure.
Figure 2:
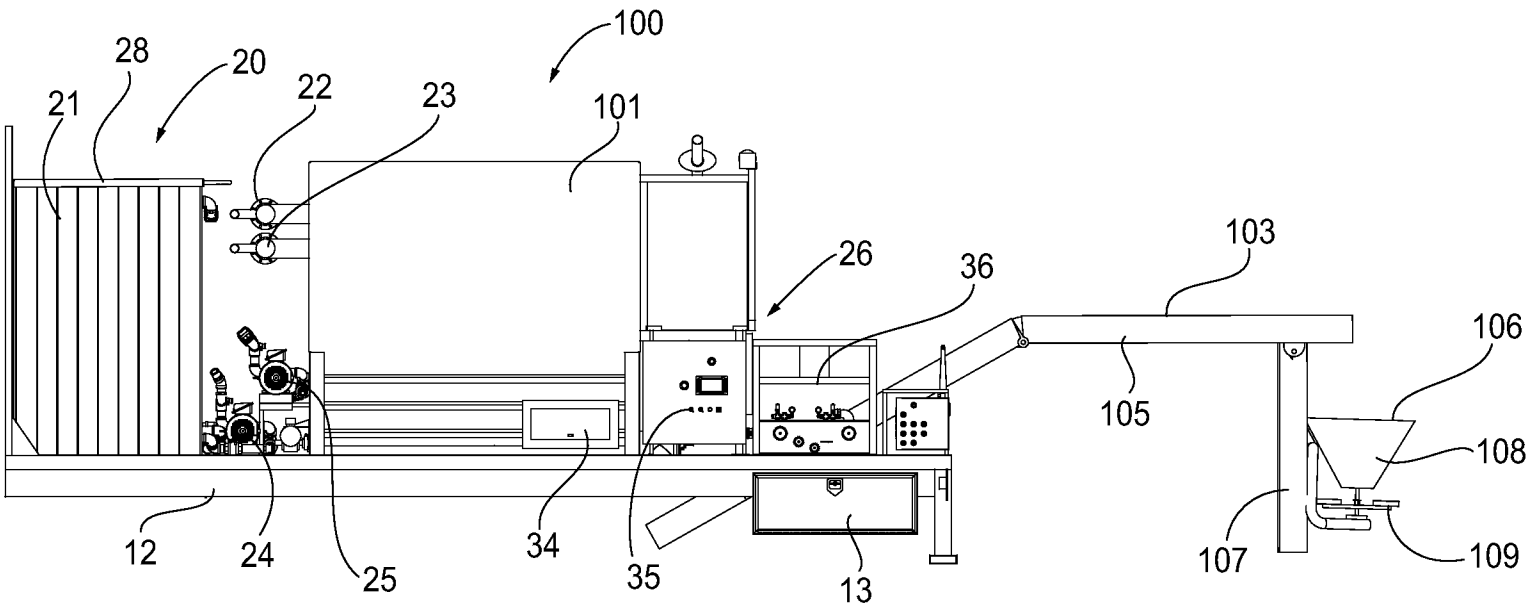
FIG. 2 is an opposite side view of the system of FIG. 1 with the truck chassis omitted.
Figure 3:
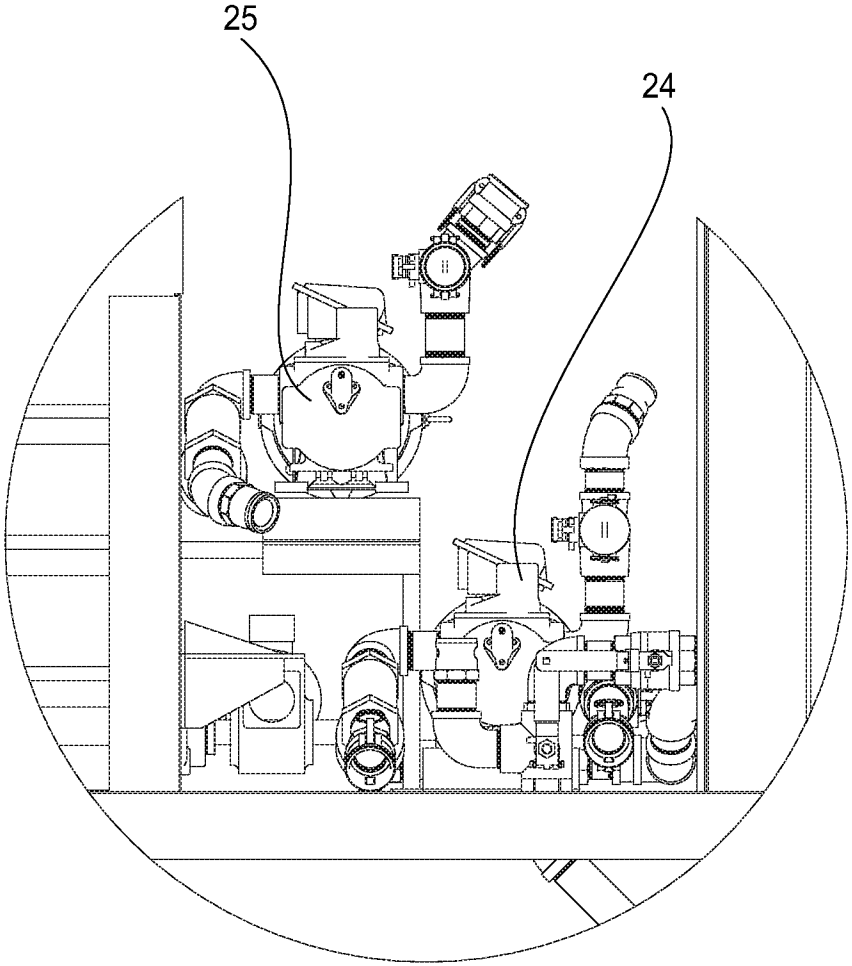
FIG. 3 is an enlarged view of area "III" shown in FIG. 1.

For purposes of the description hereinafter, the terms "end", "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings and described in the following specification are simply exemplary embodiments or aspects of the invention. Hence, specific dimensions and other physical characteristics related to the embodiments or aspects disclosed herein are not to be considered as limiting.

Figure 4:
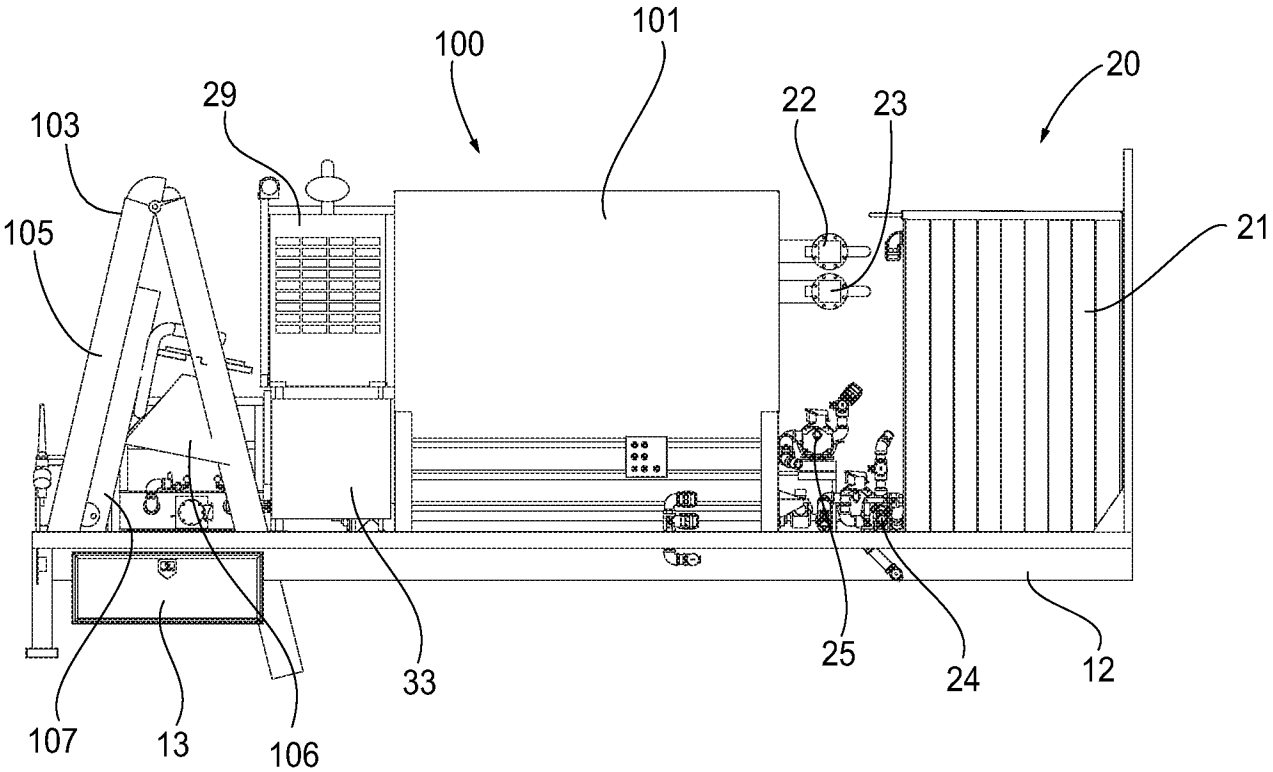
FIG. 4 is a side view of the system of FIG. 1 with the truck chassis omitted and with the conveyor assembly and spreader unit in a retracted position.
Figure 5:
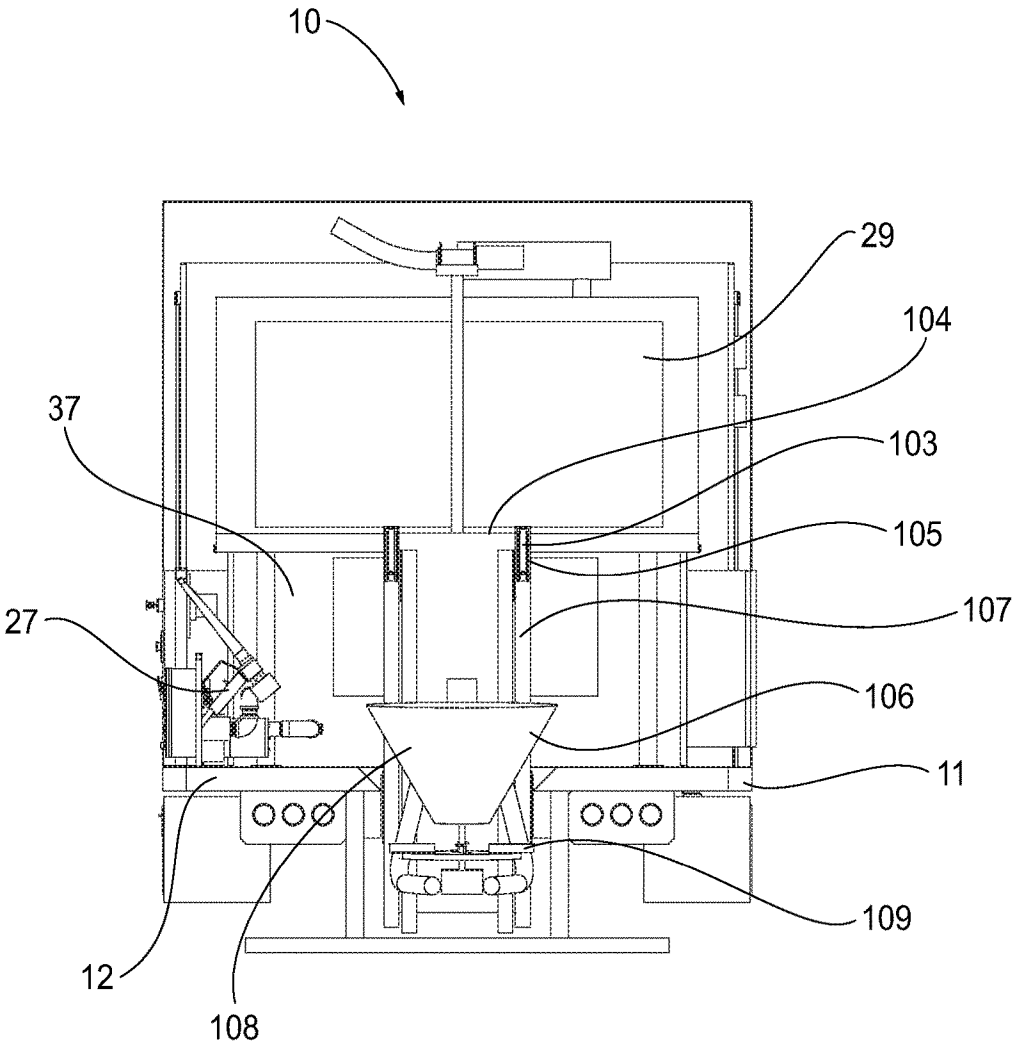
FIG. 5 is a rear view of the system of FIG. 1.
Figure 6:
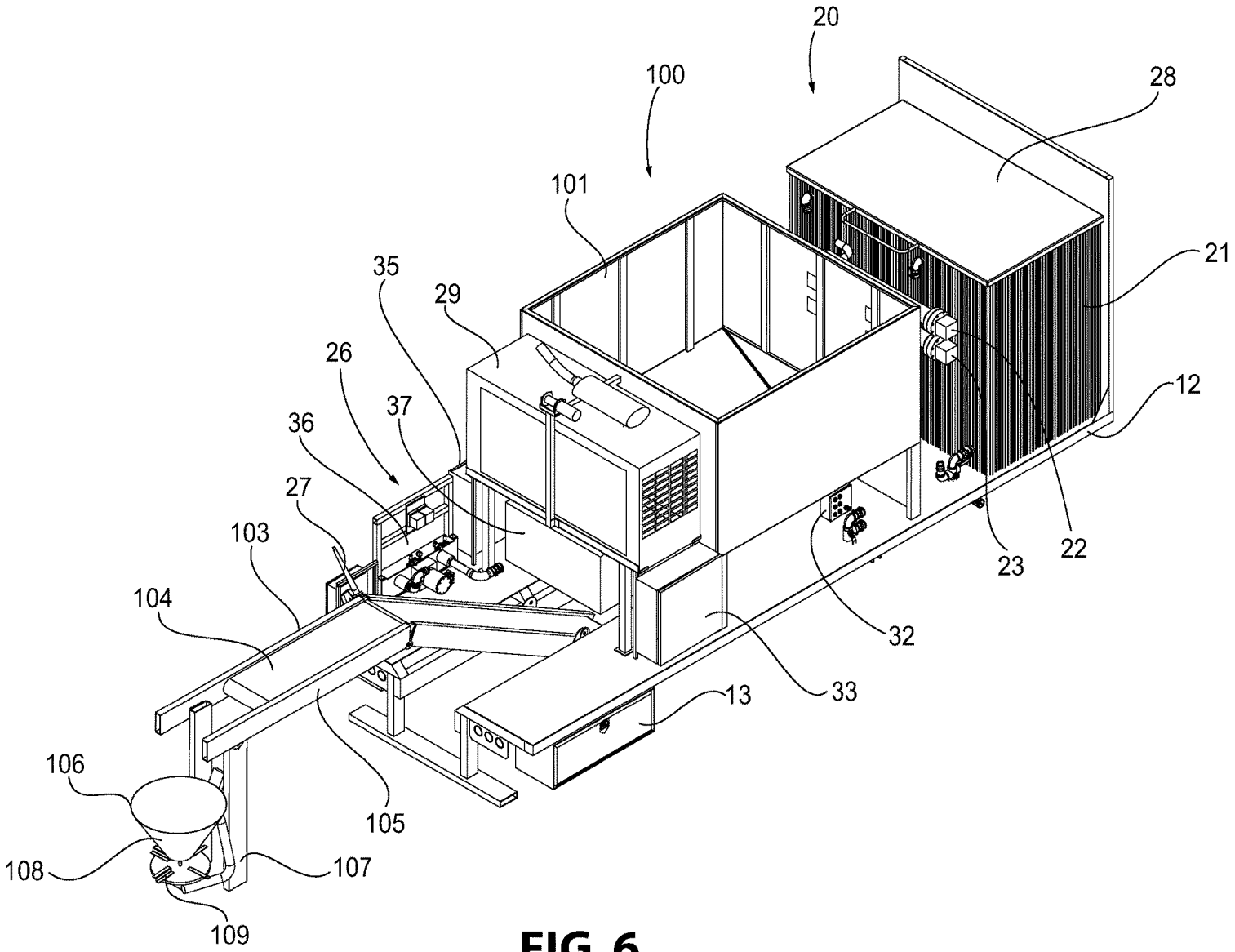
FIG. 6 is an upper perspective view of the system of FIG. 1 with the truck chassis omitted.
Figure 7:
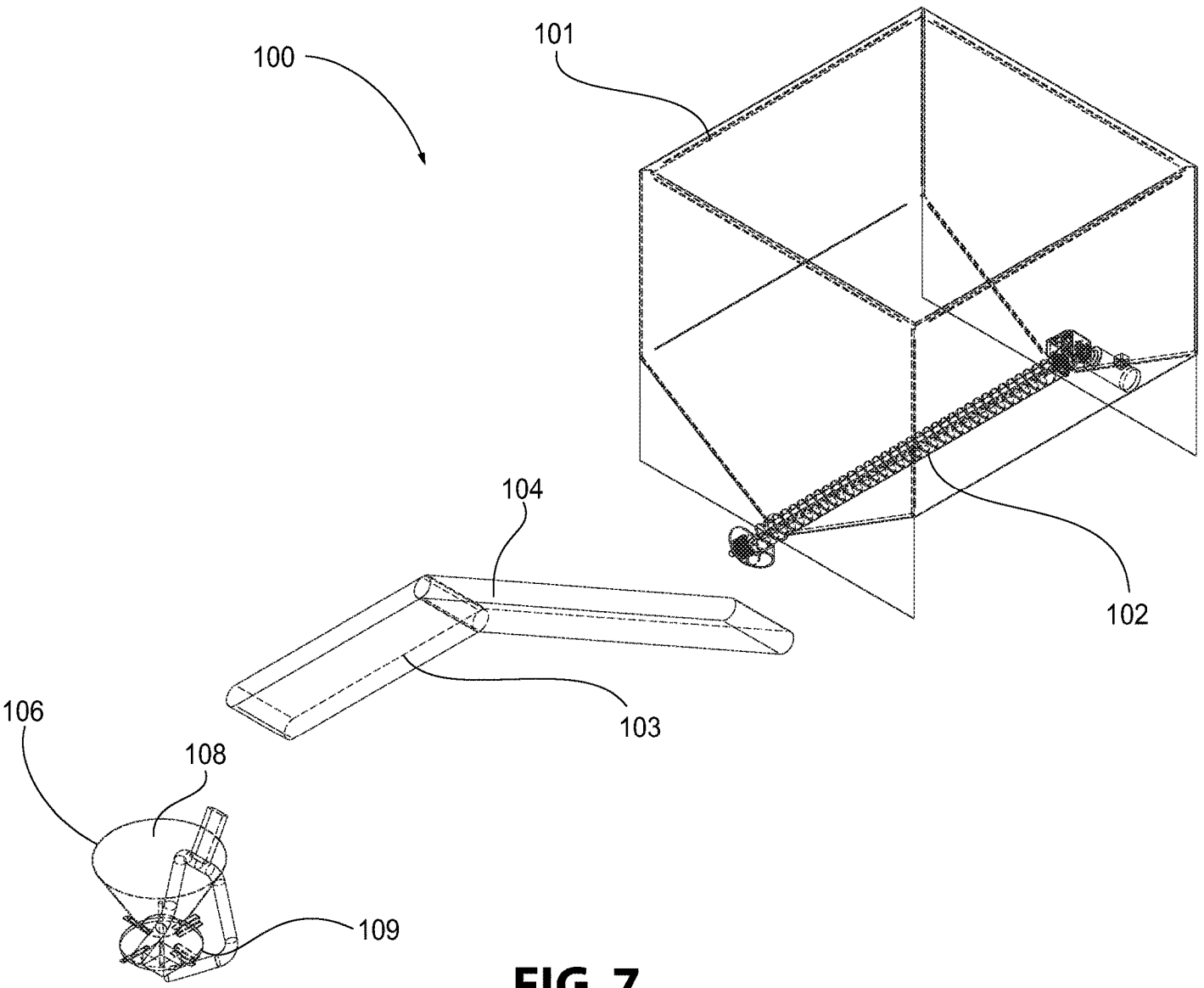
FIG. 7 is an upper perspective schematic view of an aggregate storage and spreader system of the system of FIG. 1.
Figure 8:
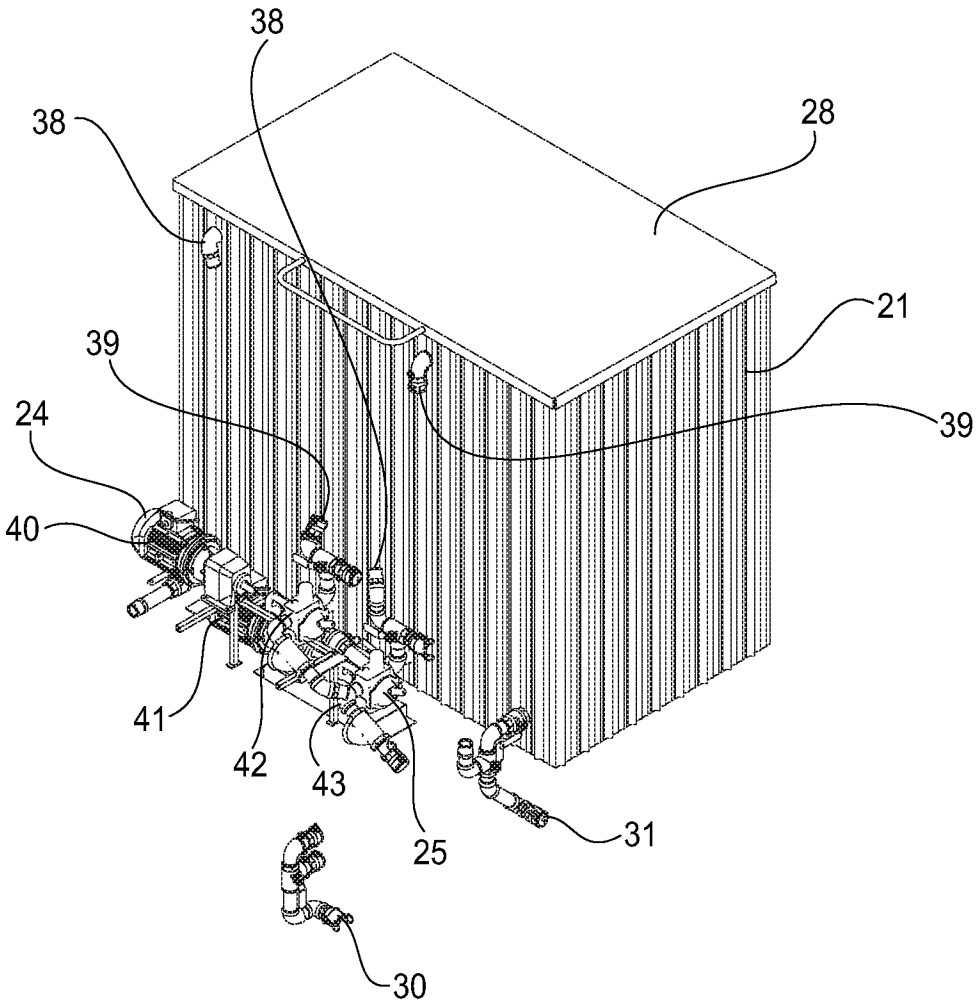
FIG. 8 is an upper perspective view of a storage tank and pump units of a coating storage and dispensing system of the system of FIG. 1.
Figure 9:
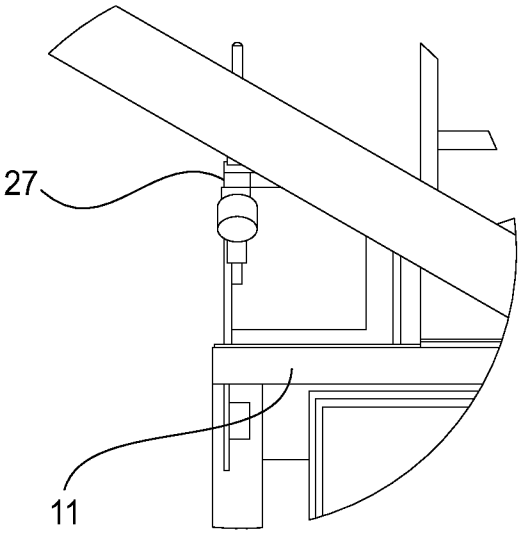
FIG. 9 is an enlarged view of "IX" shown in FIG. 1.
Figure 10C:
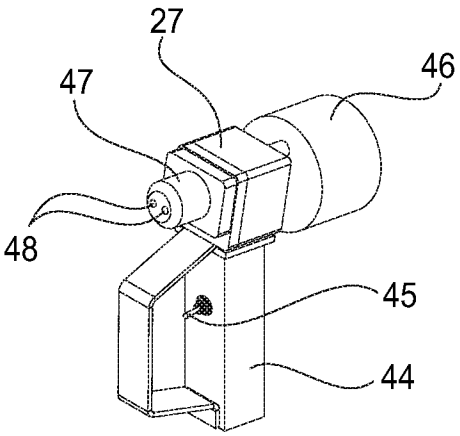
FIGS. 10A-10D are views of a dispenser of the coating storage and dispensing system of the system of FIG. 1.
Figure 10B:
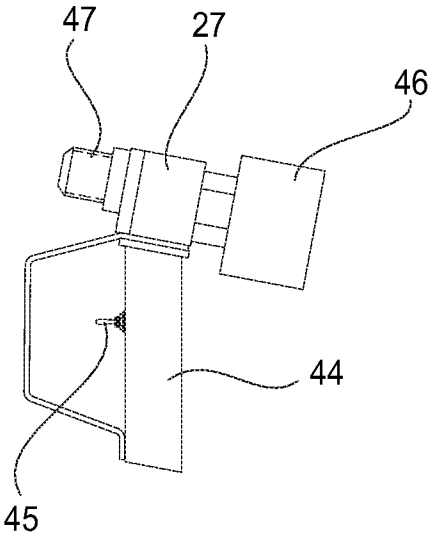
Figure 10A:
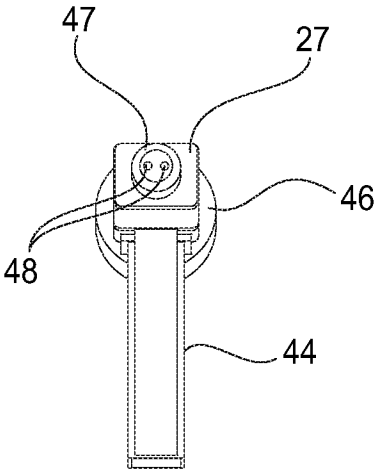
Figure 10D:
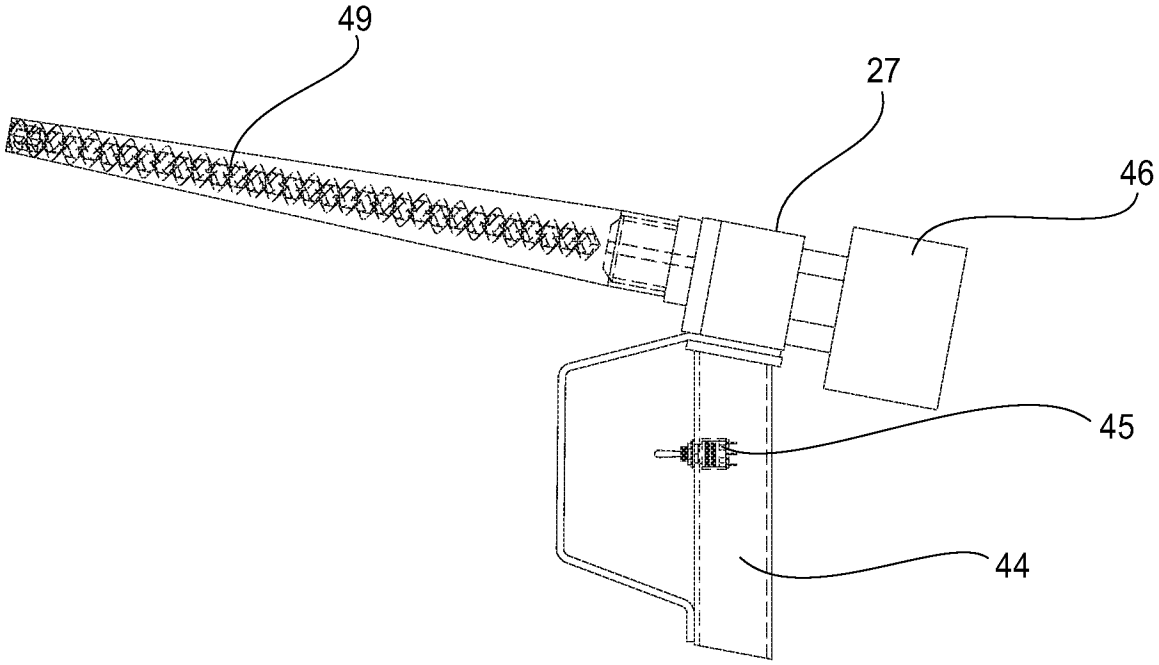

With reference to FIGS. 1-10D, a system 10 for dispensing a coating, such as an HFST epoxy liquid coating and aggregate material, to a road surface is shown in accordance with an example of the present disclosure. As shown in FIGS. 1 and 5, the system 10 is disposed on a truck chassis 11, and in particular is mounted on a flatbed 12 that is disposed on the truck chassis 11. The flatbed 12 may incorporate storage boxes 13 as would be familiar to those having ordinary skill in the art. It is to be appreciated that the system 10 may be configured for mounting on truck chassis of various sizes and configurations and that the truck chassis 11 illustrated in FIGS. 1 and 10 is one example of a suitable truck chassis 11 for use with the system 10. It is also to be appreciated that the system 10 may be configured for mounting on other vehicle or mobile structures other than a truck chassis 11.

As shown in FIGS. 1-6 and 8-10D, the system 10 includes a coating storage and dispensing system 20 disposed on the truck flatbed 12. The coating storage and dispensing system 20 includes a liquid storage unit 21 that is configured to separately contain the individual liquid components, such as the epoxy resin and hardener liquid, of the coating. In particular, the liquid storage unit 21 is configured to house and support the containers or "totes" (not shown) in which the liquid components are stored. The liquid storage unit 21 is insulated to maintain the temperature of the liquid components. Access to the liquid storage unit 21 is provided by a lid 28 hingedly connected to the liquid storage unit 21.

The coating storage and dispensing system 20 also includes a heating system made up of a plurality of heating units 22, 23. Each heating unit 22, 23 is associated with a respective liquid component of the coating in order to heat the respective liquid component to achieve a predetermined or desired viscosity for pumping, mixing, and dispensing. For instance, a first heating unit 22 is provided to heat a first liquid component, such as an epoxy resin, to achieve a predetermined or desired viscosity or to maintain the epoxy resin at the predetermined or desired viscosity. A second heating unit 23 is provided to heat a second liquid component, such as a hardener, to achieve a predetermined or desired viscosity or maintain the hardener at the predetermined or desired viscosity. According to one example, the heater units 22, 23 are connected in fluid communication with the individual containers stored within liquid storage unit 21. Each liquid component may be circulated through the respective heater unit 22, 23 as the liquid is loaded into the liquid storage unit 21 and prior to dispensing. Each liquid component may also be regularly re-circulated through the respective heater unit 22, 23 to maintain the temperature, and thus the viscosity, of the liquid component.

The coating storage and dispensing system 20 further includes a pumping system made up of a plurality of pumping units 24, 25. Each pumping unit 24, 25 is associated with a respective liquid component of the coating in order to pump the liquid component to and from the containers in the liquid storage unit 21. For instance, a first pumping unit 24 is provided to pump the first liquid component to and from the liquid storage unit 21. A second pumping unit 25 is provided to pump the second liquid component from the liquid storage unit 21. Each pumping unit 24, 25 includes a respective pump motor 40, 41 and transfer pump 42, 43, as well as any other components found to be suitable to those having ordinary skill in the art. Each pumping unit 24, 25 is in communication with the containers in the liquid storage unit 21, the respective heating unit 22, 23, a respective load port 30, 31 for the liquid component, and with a dispenser 27 for dispensing the mixed coating components to the road surface via a system of conduits. The first load port 30 is provided to load the first liquid component into the liquid storage unit 21. The second load port 31 is provided to load the second liquid component into the liquid storage unit 21. Tank return ports 38, 39 are connected to the liquid storage tank 21 for conveying the liquid components into the liquid storage tank 21.

The coating storage and dispensing system 20 includes a control unit 26 for monitoring and controlling the operation of the heating units 22, 23 and the pumping units 24, 25 so that the liquid components of the coating are maintained at the correct temperature/viscosity and are conveyed to the dispenser 27 in the correct ratios for mixing. According to one example of the disclosure, the control unit 26 operates automatically with minimal to no operator intervention to heat and dispense the liquid components. The control unit 26 may be made up of a series of separate control panels and boards for handling individual tasks of the coating and storage dispensing system 20. For instance, the control unit 26 may be made up of a transfer pump control box 32, an AST control module cabinet 35, and an AST meter system 36. It is to be appreciated that the control unit 26 may be of any type and/or configuration found to be suitable to those having ordinary skill in the art. According to one example of the present disclosure, the control unit 26 comprises a computer or series of computers that include at least one microprocessor, at least one computer memory storing software instructions, a power supply, hardware components, and input and output devices suitable for executing the operations of the system 10 described herein in an automated manner and/or with minimal operator input.

As shown in FIGS. 1, 5, 6, and 9-10D, the coating storage and dispensing system 20 includes the dispenser 27 disposed at the rear of the truck bed 12 and connected to both pumping units 24, 25 via a conduit system. The dispenser 27 is configured to mix the liquid components of the coating and then dispense the mixed coating to the road surface. According to the illustrated example, the dispenser 27 includes a hand grip 44 with an actuation switch 45 disposed thereon for activating the dispenser 27 to dispense the liquid coating. The dispenser 27 also includes an injection chamber 46 through which the liquid components are received into the dispenser 27 and a threaded nozzle bung 47. The liquid components are dispensed from the threaded nozzle bung 47 via liquid orifices 48. According to the example, the separate liquid components are mixed within a static mix nozzle 49 connected to the threaded nozzle bung 47 and then dispensed to the road surface. The dispenser 27 does not apply a spray of the mixed liquid coating due to the viscosity of the mixed liquid coating. Rather, the mixed liquid coating is poured from the dispenser 27 onto the road surface. The mixed liquid coating is then manually spread evenly over the surrounding road surface by workers using various brushes, mops, and squeegee tools before it cures. It is to be appreciated that the dispenser 27 may be of any type and configuration found to be suitable by those having ordinary skill in the art for mixing of the liquid components of the coating and then dispensing the mixed liquid coating to the road surface.

With reference to FIGS. 1-7, the system 10 includes the aggregate storage and spreader system 100 disposed on the truck bed 12 with the coating storage and dispensing system 20. The aggregate storage and spreader system 100 includes a hopper unit 101 having a storage volume that is configured to contain aggregate material loaded into the hopper unit 101. The hopper unit 101 has an open top for receiving the aggregate material and an opening in the bottom for allowing aggregate material to exit the hopper unit 101. An auger 102 is disposed in the bottom of the hopper unit 101 for dispensing the aggregate material from the bottom of the hopper unit 101. The hopper unit 101 may include sloping sidewalls so that aggregate material converges on the auger 102.

A conveyor assembly 103 is provided to direct the aggregate material from the bottom of the hopper unit 101 to the rear of the truck bed 12. The conveyor assembly 103 includes a conveyor belt 104 and a frame 105 for supporting the conveyor belt 104. The conveyor assembly 103 is movable between a folded position, shown in FIG. 4, in which the conveyor assembly 103 is retained fully on the truck bed 12, and an extended position, shown in FIG. 1, in which the conveyor assembly 103 extends rearwardly from the truck bed 12. The conveyor assembly 103 may include two pivotably connected portions. A first portion, when in the extended position, is sloped upwardly from the bottom of the hopper unit 101. A second portion, when in the extended position, is raised with respect to the truck bed 12 and extends rearwardly. The conveyor belt 104 extends across both portions of the conveyor assembly 103. It is to be appreciated that the conveyor assembly 103 may include more than one conveyor belt 104. For instance, the conveyor assembly 103 may include separate conveyor belts 104 on each of the folding portions.

The aggregate storage and spreader system 100 also includes a spreader unit 106 connected to and supported on the conveyor assembly 103 by an arm 107 extending downwardly from an end of the frame 105 of the conveyor assembly 103 beneath an end of the conveyor belt 104. The spreader unit 106 is configured to dispense and spread the aggregate material from the conveyor belt 104 to the road surface to which the liquid coating has been applied. As shown in FIGS. 1 and 4, the spreader unit 106 is movable with the conveyor assembly 103 between the folded and extended positions. This configuration eliminates the necessity of providing a separate boom for supporting the spreader unit 106 on the truck bed 12. According to an example of the present disclosure, the spreader unit 106 includes a cone-shaped hopper 108 that receives the aggregate material as it falls from the conveyor belt 104. A rotating plate/centrifuge 109 is disposed beneath the hopper 108 and spins in order to create an outward spread of the aggregate material from the spreader unit 106 to the road surface in a manner that is familiar to those having ordinary skill in the art.

It is to be appreciated that the conveyor assembly 103 may be connected to a powered winch mechanism for moving the conveyor assembly and the spreader unit 106 between the folded and extended positions. Further, a spreader/conveyor control box may be provided for controlling an automated operation of the conveyor belt 104 and the spreader unit 106. The spreader/conveyor control box may be part of the control unit 26 or may comprise a separate computer connected to the control unit 26. Alternatively, the spreader/conveyor control box may comprise a computer completely separate from the control unit 26.

It is to be appreciated that the aggregate storage and spreader system 100 may be of any construction or configuration known to be suitable to those having ordinary skill in the art.

With reference to FIGS. 1, 2, and 4-6, the system 10 also includes a generator 29 for creating power to operate the various components of both the coating storage and dispensing system 20 and the aggregate storage and spreader system 100. According to an example of the present disclosure, the generator 29 is a diesel generator supplied with diesel fuel from a fuel reservoir 37 disposed on the truck bed 12 adjacent to or below the generator 29. The electrical power created by the generator 29 is managed by controls within a power systems relay cabinet 33 and a power systems circuit breaker cabinet 34.

Accordingly, with reference to FIGS. 1-10D, the system 10 described above includes the coating storage and dispensing system 20 and the aggregate storage and spreader system 100 that function together to apply the coating treatment to the road surface. The coating storage and dispensing system 20 stores, mixes, and dispenses the liquid coating material, such as an epoxy coating. The epoxy coating is provided in two parts, an epoxy resin and a hardener, which are separately maintained in the liquid storage unit 21 and then mixed by the coating storage and dispensing system 20. The liquid storage unit 21 is configured to accommodate separate tanks for the two liquid components of the coating. The coating storage and dispensing system 20 includes the control unit 26 for mixing the liquid components at the proper ratios. The coating storage and dispensing system 20 includes the insulated liquid storage unit 21 and heating units 22, 23 for maintaining the liquid components at the temperature needed to achieve a predetermined or desired viscosity for mixing and dispensing to the road surface. The control unit 26 is provided to operate the pumping units 24, 25 and associated components so that the liquid components are mixed in the correct ratios and then delivered to the dispenser 27 for directing the mixed liquid coating to the road surface.

The aggregate storage and spreader system 100 includes the hopper unit 101, which is a large receptacle having the auger 102 at the bottom. The hopper unit 101 is typically loaded by heavy equipment at a work site. The auger 102 moves the aggregate material from the bottom of the hopper unit 101 to the conveyor assembly 103. The conveyor assembly 103 includes two separate conveyors that articulate out of the rear of the truck bed 12 when the system 10 is in use and fold inside the truck bed 12 for travel. The aggregate material falls on a conveyor belt 104 once it has exited the bottom of the hopper unit 101 via the auger 102. The aggregate material rides on the conveyor belt 104 and toward the rear end of the conveyor assembly 103. The aggregate storage and spreader system 100 also includes the spreader unit 106, which spreads the aggregate material on the road surface using a centrifugal-type spreading motion. The aggregate material falls from the rear of the conveyor assembly 103 into the hopper 108 of the spreader unit 106. The aggregate material exits the hopper 108 onto the rotating plate/centrifuge 109, which spreads the aggregate material outwardly onto the road surface.

With reference to FIGS. 1-10D, according to one example of the present disclosure, a method for dispensing a coating to a road surface is provided. The method includes providing the truck chassis 11; separately containing the plurality of individual liquid components of the coating in a liquid storage unit 21 disposed on the truck chassis 11; storing the aggregate material in the hopper unit 101 disposed on the truck chassis 11; separately heating each of the plurality of individual liquid components to achieve the predetermined or desired viscosity moving the truck chassis 11 along the road surface; separately pumping each of the plurality of individual liquid components from the liquid storage unit 21 to a dispenser 27 at a predetermined ratio for forming the coating; mixing each of the plurality of individual liquid components at the dispenser 27; dispensing a mixed liquid coating to the road surface; conveying the aggregate material from the hopper unit 101 to a spreader unit 106 extended from a rear of the truck chassis 11; and dispensing the aggregate material to the road surface with the spreader unit 106 after the coating has been dispensed to the road surface.

The conveying step is performed by a conveyor assembly 103 movably disposed on the truck chassis 11 and the spreader unit 106 is connected to the conveyor assembly 103. The method further includes moving the conveyor assembly 103 and the spreader unit 106 between a folded position in which the conveyor assembly 103 and spreader unit 106 are retained on the truck chassis 11 and an extended position in which the conveyor assembly 103 and spreader unit 106 extend rearwardly from the truck chassis 11.

The heating step includes circulating each of the plurality of individual liquid components between a respective heater unit 22, 23 and the liquid storage unit 21.

The step of dispensing the coating to the road surface includes pouring the mixed liquid coating from the dispenser 27 onto the road surface and spreading the mixed liquid coating evenly over the road surface.

While specific embodiments of the invention have been described in detail, it will be appreciated by those having ordinary skill in the art that various modifications and alternatives to those details could be developed in light of the overall teachings of the disclosure. The presently preferred embodiments described herein are meant to be illustrative only and not limiting as to the scope of the invention, which is to be given the full breadth of the appended claims and any and all equivalents thereof.

The invention claimed is:

1. A truck-mounted system for dispensing a coating to a road surface, comprising:

a truck chassis;

a coating storage and dispensing system disposed on the truck chassis, the coating storage and dispensing system comprising:

a liquid storage unit configured to separately contain a plurality of individual liquid components of the coating;

a heating system comprising a plurality of heater units, each heater unit being configured to heat a respective one of the plurality of individual liquid components to achieve a predetermined viscosity;

a pumping system comprising a plurality of pumping units, each pumping unit configured to pump a respective one of the plurality of individual liquid components from the liquid storage unit;

a control unit configured to operate the pumping units to pump the plurality of individual liquid components from the liquid storage unit at a predetermined ratio for forming the coating; and a dispenser configured to mix the plurality of individual liquid components pumped from the liquid storage units and dispense the coating to the road surface, the dispenser comprising a hand grip having an actuation switch disposed thereon for activating the dispenser; and an aggregate storage and spreader system disposed on the truck chassis, the aggregate storage and spreader system comprising:

a hopper unit comprising a storage volume configured to contain an aggregate material;

an auger disposed at a bottom of the hopper unit, the auger being configured to dispense the aggregate material from the bottom of the hopper unit;

a conveyor assembly configured to direct the aggregate material from the bottom of the hopper unit to a rear of the truck chassis, the conveyor assembly being movable between a folded position in which the conveyor assembly is retained on the truck chassis and an extended position in which the conveyor assembly extends rearwardly from the truck chassis, the conveyor assembly comprising at least one conveyor belt; and a spreader unit connected to the conveyor assembly, the spreader unit being configured to dispense the aggregate material from the conveyor assembly to the road surface, wherein the spreader unit is movable with the conveyor assembly between the folded and extended positions.

2. The truck-mounted system according to claim 1, wherein the plurality of individual liquid components comprises an epoxy resin liquid component and a hardener liquid component.

3. The truck-mounted system according to claim 1, wherein the dispenser further comprises an injection chamber through which the individual liquid components are received into the dispenser, a threaded nozzle bung, and a static mix nozzle connected to the threaded nozzle bung, the individual liquid components being mixed in the static mix nozzle.

4. The truck-mounted system according to claim 1, wherein the conveyor assembly comprises a first portion that, when in the extended position, is sloped upwardly from the bottom of the hopper unit and a second portion that, when in the extended position, extends rearwardly from the truck chassis, the first portion and the second portion of the conveyor assembly being pivotably connected, and the at least one conveyor belt extending across the first portion and the second portion.

5. The truck-mounted system according to claim 1, wherein the spreader unit comprises a cone-shaped hopper configured to receive the aggregate material from the at least one conveyor belt and a rotating plate disposed beneath the cone-shaped hopper that is configured to spin to create an outward spread of the aggregate material from the spreader unit to the road surface.

6. The truck-mounted system according to claim 1, further comprising a generator configured to supply power to the coating storage and dispensing system and the aggregate storage and spreader system.

7. A system for dispensing a coating to a road surface, comprising:

a coating storage and dispensing system, comprising:

a liquid storage unit configured to separately contain a plurality of individual liquid components of the coating;

a heating system comprising a plurality of heater units, each heater unit being configured to heat a respective one of the plurality of individual liquid components to achieve a predetermined viscosity;

a pumping system comprising a plurality of pumping units, each pumping unit configured to pump a respective one of the plurality of individual liquid components from the liquid storage unit;

a control unit configured to operate the pumping units to pump the plurality of individual liquid components from the liquid storage unit at a predetermined or desired ratio for forming the coating; and a dispenser for dispensing the coating to the road surface, the plurality of individual liquid components of the coating being mixed at the dispenser, the dispenser comprising a hand grip having an actuation switch disposed thereon for activating the dispenser; and an aggregate storage and spreader system comprising:

a container comprising a storage volume configured to contain an aggregate material; and a spreader unit in communication with the container and configured to dispense the aggregate material from the container to the road surface.

8. The system according to claim 7, wherein the coating storage and dispensing system and the aggregate storage and spreader system are configured to be mounted on a truck chassis.

9. The system according to claim 7, wherein the container of the aggregate storage and spreader system comprises a hopper unit and an auger disposed at a bottom of the hopper unit, the auger being configured to dispense the aggregate material from the bottom of the hopper unit.

10. The system according to claim 7, wherein the plurality of individual liquid components comprises an epoxy resin liquid component and a hardener liquid component.

11. The system according to claim 7, wherein the dispenser further comprises an injection chamber through which the individual liquid components are received into the dispenser, a threaded nozzle bung, and a static mix nozzle connected to the threaded nozzle bung, the individual liquid components being mixed in the static mix nozzle.

12. The system according to claim 7, wherein the spreader unit comprises a cone-shaped hopper configured to receive the aggregate material from the container and a rotating plate disposed beneath the cone-shaped hopper that is configured to spin to create an outward spread of the aggregate material from the spreader unit to the road surface.

13. The system according to claim 7, further comprising a generator configured to supply power to the coating storage and dispensing system and the aggregate storage and spreader system.

14. The system according to claim 7, wherein the aggregate storage and spreader system further comprises a conveyor assembly configured to direct the aggregate material from the container to the spreader unit, the conveyor assembly comprising at least one conveyor belt and being movable between a folded position and an extended position, the spreader unit being movable with the conveyor assembly between the folded and extended positions.

15. The system according to claim 14, wherein the conveyor assembly comprises at least two pivotably connected portions and the at least one conveyor belt extends across the at least two pivotably connected portions.

16. A method for dispensing a coating to a road surface, comprising:

providing a truck chassis;

separately containing a plurality of individual liquid components of the coating in a liquid storage unit disposed on the truck chassis;

storing aggregate material in a hopper unit disposed on the truck chassis;

separately heating each of the plurality of individual liquid components to achieve a predetermined viscosity;

moving the truck chassis along the road surface;

separately pumping each of the plurality of individual liquid components from the liquid storage unit to a dispenser at a predetermined ratio for forming the coating;

mixing each of the plurality of individual liquid components at the dispenser;

dispensing a mixed liquid coating to the road surface, the dispensing step being performed by the dispenser, the dispenser comprising a hand grip having an actuation switch disposed thereon for activating the dispenser;

conveying the aggregate material from the hopper unit to a spreader unit extended from a rear of the truck chassis; and dispensing the aggregate material to the road surface with the spreader unit after the coating has been dispensed to the road surface.

17. The method according to claim 16, wherein the conveying step is performed by a conveyor assembly movably disposed on the truck chassis and the spreader unit is connected to the conveyor assembly, the method further comprising moving the conveyor assembly and the spreader unit between a folded position in which the conveyor assembly and spreader unit are retained on the truck chassis and an extended position in which the conveyor assembly and spreader unit extend rearwardly from the truck chassis.

18. The method according to claim 16, wherein the plurality of individual liquid components comprises an epoxy resin liquid component and a hardener liquid component.

19. The method according to claim 16, wherein the heating step comprises circulating each of the plurality of individual liquid components between a respective heater unit and the liquid storage unit.

20. The method according to claim 16, wherein the step of dispensing the coating to the road surface comprises pouring the mixed liquid coating from the dispenser onto the road surface and spreading the mixed liquid coating evenly over the road surface.

* * * * *